United States Patent [19]

Ejima et al.

[11] Patent Number: 4,818,587

[45] Date of Patent: Apr. 4, 1989

[54] NONWOVEN FABRICS AND METHOD FOR PRODUCING THEM

[75] Inventors: Shozo Ejima, Moriyama; Taizo Sugihara, Omihachiman; Morio Abe, Shiga, all of Japan

[73] Assignee: Chisso Corporation, Osaka, Japan

[21] Appl. No.: 108,459

[22] Filed: Oct. 15, 1987

[30] Foreign Application Priority Data

Oct. 17, 1986 [JP] Japan ..... 61-245425
Aug. 21, 1987 [JP] Japan ..... 62-207823

[51] Int. Cl.[4] ..... D02G 2/00

[52] U.S. Cl. ..... 428/198; 156/62.4; 156/62.6; 156/308.2; 428/288; 428/296; 428/373; 428/374

[58] Field of Search ..... 428/373, 374, 296, 288, 428/198; 156/62.4, 62.6, 308.2

[56] References Cited

U.S. PATENT DOCUMENTS 3,511,747 5/1970 Davies ..... 161/150
4,370,114 1/1983 Okamoto et al. ..... 425/131.5
4,469,540 9/1984 Furukawa et al. ..... 156/62.4
4,551,378 11/1985 Carey ..... 428/296

*Primary Examiner*—Marion C. McCamish
*Attorney, Agent, or Firm*—Oblon, Fisher, Spivak, McClelland & Maier

[57] ABSTRACT

Nonwoven fabrics contain at least 30% by weight of heat-adhesive composite fibers consisting of core portion and sheath portion, said core portion being of the side-by-side type composite structure comprising two core components of different polypropylene base polymers in a composite ratio of 1:2 to 2:1, one of said core components having a Q value, expressed in terms of the weight-average molecular weight/the number-average molecular weight, equal to or higher than 6 and the other having a Q value equal to or lower than 5, and said sheath portion meeting at least the requirement that it should comprise a sheath component of a polyethylene base polymer having a melting point lower by at least 20° C. than the lower one of the melting points of said two core components. The nonwoven fabrics are bulky and soft due to the crimps of the heat-adhesive composite fibers resultant from the core portion and are stabilized by the inter-fiber bonds of the sheath portion.

11 Claims, 1 Drawing Sheet

NONWOVEN FABRICS AND METHOD FOR PRODUCING THEM

BACKGROUND OF THE INVENTION

1. Field of the Invention

Figure 1:
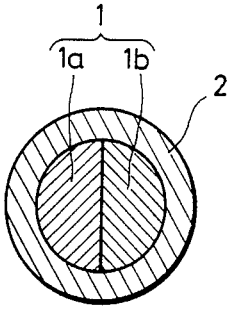

The present invention relates to nonwoven fabrics which is bulky and has a soft touch or feeling, and a method for producing the same nonwoven fabrics.

2. Statement of the Prior Art

Many years have elapsed since there were known in the art the side-by-side or sheath-core type polypropylene base heat-adhesive composite fibers, which comprised two components having different melting points, and had a considerable portion, e.g., one half or more portion of their surfaces occupied by the component having a lower melting point, and the nonwoven fabrics made thereof. In the meantime, various improvements have been achieved. As disclosed in, e.g., Japanese Patent Publication No. 52-12830, Japanese Patent Laid-Open Publication No. 58-136867 and Japanese Patent Laid-Open Publication No. 58-180614, such improvements have primarily aimed at improving the shrink properties of a web in processing the fibers into a nonwoven fabric by heating and enhancing the strength, bulkiness and like factors of the resulting nonwoven fabric, and appreciable outcomes have been attained, but, referring to the bulkiness, any satisfactory outcome has been not yet achieved.

Hitherto, any appreciable outcome has been not attained in terms of not only the bulkiness but also the touch or feeling of nonwoven fabrics obtained from the polypropylene base heat-adhesive composite fibers by a heat treatment. Improvements in touch or feeling have been attempted as by using fine deniers or increasing the proportion of other fibers to be mixed with the composite fibers, such as rayon or wool, but have not still resulted in any product excelling in bulkiness and softness. The situation being like this, a strong demand for further improvements in the bulkiness and softness of nonwoven fabrics intended for purposes such as paper diapers or sanitary materials is not satisfied. Thus, it is strongly desired to meet such a demand.

SUMMARY OF THE INVENTION

A main object of the present invention is to provide nonwoven fabrics which is not only bulky but has also a highly soft touch or feeling.

As a result of intensive and extensive studies made to attain the object, it has been found that the nonwoven fabric structure is extremely stabilized and sufficiently bulked and have soft touch or feeling, when the composite fibers to be processed into nonwoven fabrics are constructed by a core portion which imparts bulkiness to the nonwoven fabrics and a sheath portion which imparts heat adhesiveness to the fibers and, furthermore, in addition to the above-mentioned construction, when a number of nodular aggregates consisting of the sheath component are formed on the surfaces of the fibers except for the portions of the fibers bonded together, the soft touch or feeling is further improved.

According to one (or the first) aspect of the present invention, there is provided a nonwoven fabric which contains at least 30% by weight of heat-adhesive composite fibers comprising a core portion and a sheath portion, said core portion being of the side-by-side type composite structure comprising two core components of different polypropylene base polymers in a composite ratio of 1:2 to 2:1, one of said core components having a Q value, expressed in terms of the weight-average molecular weight/the number-average molecular weight, equal to or higher than 6 and the other having a Q value equal to or lower than 5, said sheath portion meeting at least the requirement (hereinafter referred to as the sheath requirement) that it should comprise a sheath component of a polyethylene base polymer having a melting point lower by at least 20° C. than the lower one of the melting points of said two core components, and said sheath portion covering completely said core portion in a proportion of 25 to 55% by weight based on the total weight of it and said core portion, and which is stabilized by the inter-fiber bonds of the sheath portion of said heat-adhesive composite fibers.

According to another (or the second) aspect of the present invention, there is provided a method for producing nonwoven fabrics which comprises the steps of:

separately subjecting to composite-spinning two polypropylene base polymers for two core components and a polyethylene base polymer for a sheath component, which has a melting point lower by at least 20° C. than the lower one of the melting points of said two polypropylene base polymers, thereby obtaining a composite nonstretched yarns of the structure that a core portion of the side-by-side type composite structure consisting of two core components in a composite ratio of 1:2 to 2:1, one of said core components having a Q value, expressed in terms of the weight-average molecular weight/the number-average molecular weight, equal to or higher than 6 and the other having a Q value equal to or lower than 5, is completely covered with a sheath portion comprising said sheath component in a weight proportion of 25 to 55% by weight based on the total weight of it and said core portion, stretching said composite nonstretched yarn by an one- or more-stage stretching process to prepare heat-adhesive composite fibers, preparing a web containing at least 30% by weight of said heat-adhesive composite fibers, and heat-treating said web at a temperature higher than the melting point of said sheath component and lower than the lower one of the melting points of said core components.

EXPLANATION OF THE FIRST ASPECT OF THE INVENTION

The 1st aspect of the present invention will now be concretely explained. First of all, the heat-adhesive composite fibers used in the nonwoven fabrics according to the present invention will be explained with reference to FIGS. 1, 2 and 3, each being a schematical section showing the section structure of the heat-adhesive composite fiber used in the present invention, and FIG. 4 being a sketch depicting the sheath portion on which nodular agglomerates are formed.

Figure 2:
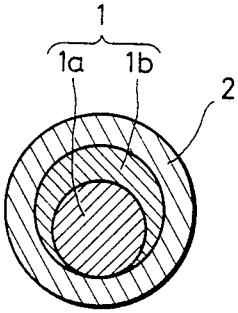
Figure 3:
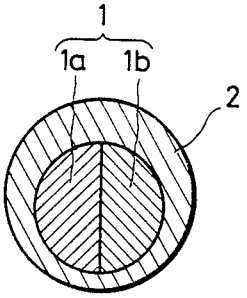

Reffering to the drawings, reference numeral 1 is a core portion of the side-by-side type composite structure comprising core-dividing zones 1*a* and 1*b* each consisting of a core component of a different polypropylene base polymer. The side-by-side type composite structure of the core 1 may take on various forms. For instance, the core 1 may be of the sectional structure which is diametrically divided into two identical semicircles, as illustrated in FIG. 1. Alternatively, the core 1 may be of the sectional structure in which one coredividing zone 1*a* is mostly surrounded with the other coredividing zone 1*b*, except for its slight peripheral portion, as illustrated in FIG. 2. In most cases, the core actually assumes a structure lying between the aforesaid extreme structures. Still alternatively, the core 1 may be located off the center in section of the fibers, as illustrated in FIG. 3.

Polypropylene base polymers, which are represented by crystalline polypropylene, may include copolymers of propylene with a small amount of other alpha-olefins save propylene, such as ethylene, butene-1 or pentene-1. In this case, it is preferred that the comonomer component content is up to 40% by weight.

Such polypropylene base polymers are used as the core components of the respective core-dividing zones 1*a* and 1*b*, and are different from each other in the Q value that is a numerical value expressing the molecular weight distribution of polymers and calculated from the following equation:

$$Q=Mw/Mn$$

wherein Mw stands for the weight-average molecular weight, and Mn indicates the number-average molecular weight.

The core component of one core-dividing zone 1*a* (which may hereinafter be simply referred to as the component 1*a*) has a Q value of at least 6 and corresponds to the general-purpose polypropylene, while that of the other core-dividing zone 1*b* (which may hereinafter be simply referred to as the component 1*b*) has a Q value of up to 5, preferably 3 to 5.

The composite ratio of the core components 1*a* and 1*b* forming the core 1 is in a range of 1:2 to 2:1.

Thus, the side-by-side type composite structure of the core 1 comprising the components 1*a* and 1*b* having different Q values assures that revealed crimps and latent crimps to be developed by a heat treatment are imparted to the composite fibers to thereby make the nonwoven fabrics bulky.

Reference numeral 2 is a sheath portion which is formed of a sheath component of a polyethylene base polymer, the melting point of which is lower by at least 20° C. than the lower one of the melting points of the two core components of the core 1, viz., the components 1*a* and 1*b* (or the melting point common to the components 1*a* and 1*b*, if there is no difference in the melting point therebetween). Such polyethylene base polymer may include polyethylene or a copolymer of ethylene/vinyl acetate, having an ethylene content of 98 to 60% by weight. That polyethylene is exemplified by a low-, intermediate- or high-density polyethylene.

The sheath-core type composite fibers of the present invention are constituted by covering the core 1 with the sheath 2 in such a manner that the proportion of the sheath 2 is in a range of 25 to 55% by weight based on the total weight of it and the core 1. When the proportion of the sheath 2 is below 25% by weight, the strength of the resulting nonwoven fabric decreases to such a low level that some problems arise practically. In a proportion of the sheath 2 exceeding 55% by weight, on the other hand, the development of the crimps due to the core 1 is inhibited so that the composite fibers are insufficiently crimped and, hence, the resulting nonwoven fabrics become inferior in bulkiness.

As described above, since the sheath 2 is formed of a polyethylene base polymer of a low melting point, the inter-fiber bonds can be formed by a heat treatment as in the case of the conventional heat-adhesive composite fibers.

Figure 4:
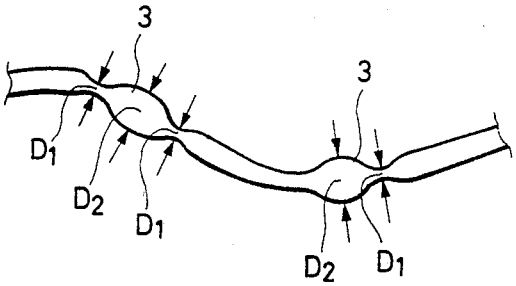

As long as the sheath 2 meets the aforesaid sheath requirement that it be of the above-mentioned structure, a nonwoven fabric product obtained by using as the raw material the heat-adhesive composite fibers constituted by it together with the core 1 may have a sufficient bulkiness and shown excellent touch or feeling. Moreover, the following structure may impart a much softer touch or feeling to the nonwoven facbric product. More specifically, the structure is such that the sheath 2 has on a number of its portions nodular aggregates 3 consisting of the sheath component, as illustrated in FIG. 4. In most cases, a diameter ($D_2$) of the greatest portion of the nodular aggregate 3 is about two times the diameter ($D_1$) of the thinnest portion adjacent thereto. Per one centimeter of the actual length of fiber, there are formed 0.1 to 0.5 nodular aggregates 3 having such a diameter ($D_2$). When the proportion of the sheath 2 exceeds 55% by weight of the total weight of it and the core, the number of the aggregates 3 formed is not sufficient and, hence, makes no contribution to improvements in the touch or feeling of nonwoven fabrics.

Although no special limitation is imposed upon the fineness of the heat-adhesive composite fibers, 1.5 to 7 deniers are suitable in applications in which weight is given to the touch or feeling of nonwoven fabrics. More suitable is a range of a finer value of 0.7 to 7 deniers.

The nonwoven fabrics according to the present invention may consist of the aforesaid heat-adhesive composite fibers alone, or may comprise at least 30% by weight thereof and other fibers such as, for instance, rayon, wool, hemp, polyamide fibers, polyester fibers and acryl fibers, and are allowed to be of the nonwoven structure by the inter-fiber bonds of the sheath 2 of the aforesaid heat-adhesive composite fibers.

EXPLANATION OF THE 2ND ASPECT OF THE INVENTION

In manufacturing the nonwoven fabrics according to the present invention, the heat-adhesive composite fibers are first prepared in the following manner. Provided are three polymers, i.e., two polypropylene base polymers for the core components and one polyethylene base polymer for the sheath component, as already mentioned in connection with the 1st aspect of the present invention. With regard to the polypropylene base polymers for the core components, the polypropylne base polymer for the component 1*a* having a Q value of at least 6 should preferably show a melt flow rate (hereinafter sometimes abbreviated as MFR and measured according to Table 1, Condition 14 provided by JIS K 7210) of 4 to 40, and the polypropylene base polymer for the component 1*b* having a Q value of 5 or less should preferably show a melt flow rate of 4 to 60. Polypropylene base polymers having a Q value of 5 or less may be prepared by the following methods, using polypropylene base polymers having a Q value of more than 5 as the starting material. According to the one method, added to and mixed with the starting polymer is an organic peroxide compound in an amount of 0.01 to 1.0% by weight based on the staring polymer, said organic peroxide compound releasing oxygen by heating at a temperature equal to or higher than the melting point of the starting polymer, such as t-butyl hydroperoxide, cumene hydroperoxide or 2,5-dimethylhexane-2,5-dihydroperoxide, etc., and the resulting mixture is subjected to melting extrusion from an extruder for granulation. According to another method, the starting polymer may be subjected to melting extrusion several times at elevated temperatures, with no addition of the aforesaid organic perioxide compound, for repeated granulation. Since the Q value is decreased a little by melting extrusion, the polymer for the component 1*a* before melt spinning should preferably have a Q value of slightly higher than 6, while the polymer for the component 1*b* may have a Q value of slightly higher than 5. The polyethylene base polymer should preferably have a melt index (hereinafter sometimes abbreviated as MI and measured according to Table 1, Condition 4 provided by JIS K 7210) of 2 to 50.

After the aforesaid three polymers have been provided, they are separately supplied to the respective three extruders for melting extrusion, and the obtained molten polymers are guided to a known appropriate composite spinning nozzle by way of the respective gear pumps. For instance, such a spinning nozzle as disclosed in Japanese Patent Publication No. 44-29522 may be used as the known composite spinning nozzle capable of spinning out three polymer components into a sectional structure similar to that of the heat-adhesive composite fibers according to the present invention. When the aforesaid three polymers are guided to such a spnning nozzle, the outputs of the respective gear pumps are regulated in such a manner that the ratio of the amounts of the polymers for the core components 1*a* and 1*b* is a given composite ratio within the range of 2:1 to 1:2, and the amount of the polymer for the sheath component is a given one within the range of 25 to 55% by weight based on the total amount of it and the core components.

The thus obtained nonstretched composite yarns of the given sectional structure are stretched in a single or multi-stage manner. To increase the latent crimping properties of the obtained composite yarns, it is generally preferred that the multi-stage stretching is carried out under the condition that the first-stage stretching temperature be lower than the second-stage stretching temperture, and that the single-stage stretching is effected at normal temperature (15° to 40° C.) or a relatively low temperature close thereto. Since stretching is usually accompanied by the generation of heat, the single-stage stretching or the first-stage stretching of the multi-stage stretching is preferably carried out while passing the yarns through the water maintained at normal temperature, or in a room maintained at normal temperature by cooling water.

The stretching conditions vary somewhat depending upon the heat-adhesive composite fibers to be produced.

If it is intended to produce the heat-adhesive composite fibers meeting only the aforesaid sheath requirement imposed upon the sheath 2, the stretching temperature may then be within a range of normal temperature (15° to 40° C.) to 130° C. The draw ratio is within a range of 1.3 to 9, preferably 1.5 to 6, as expressed in terms of the overall draw ratio. Especially, the following stretching conditions are very preferable, viz., the stretching temperature being normal temperature with the draw ratio being within a range of 4 to 5 at the first-stage stretching, and the stretching temperature being within a range of 70° to 90° C. with the draw ratio being within a range of 0.8 to 0.9 at the second-statge stretching.

If it is intended to produce the heat-adhesive composite fibers meeting the aforesaid sheath requirement and further having many aggregatable portions, as defined later, on the sheath 2, stretching has to be effected by somewhat complicated steps as mentioned below. Prior to stretching, the composite nonstretched yarns are first by heat-treated under no tension at a temperature ranging from 80° C. to below the melting point of the sheath component for 10 seconds or longer, preferably for 12 to 180 seconds. This heat treatment promotes the crystallization of the two core components 1*a* and 1*b*, and decreases the interface affinity of the sheath 2 with respect to the core 1. For the heat treatment, for instance, the yarns may be continuously passed through a dry heat oven or hot water, or batchwise treated in a large dryer. The heat-treated nonstretched yarns are cooled down to normal temperature (15° to 40° C.), and the first-stage stretching is then carried out at that normal temperature in a draw ratio of 1.3 to 2, preferably 1.5 to 1.8. Synergistically combined with the said heat treatment occurring prior to stretching, the first-stage stretching promotes a reduction in the interface affinity between the sheath 2 and the core 1. In consequence, the sheath 2 is actually or latently released from the core 1 at their interface to produce many portions on which the aggregates 3 are to be formed by the heat treatment as described later (the portions are defined as the aggregatable portions). A drew ratio exceeding 2 at the first-stretching stage offers problems such as fuzzing, a drop in fiber strength and an increase in the degree of shrinkage of the resulting nonwoven fabrics, whilst a draw ratio of less than 1.3 renders it difficult to obtain the effects as contemplated in the present invention. Subsequently following the first-stage stretching, the second-stage stretching is carried out, without relaxing the yarns between the first-stage stretching and the second-stage stretching, at a temperature of 80° C. or higher and below the melting point of the sheath component. In this case, the draw ratio should be equal to or higher than 90% of the maximum draw ratio (at which the yarns drawn at the first-stage stretching begin to snap off by a gradual increase in the draw ratio at the second-stage stretching). As the fibers are stretched at the second stage without letting the fibers loose after the first-stage stretching, as mentioned above, it is possible to prevent the fibers from being entangled together due to the crimps to be developed by fiber releasing and snapping off by the second-stage stretching. The second-stage stretching carried out at the temperature and draw ratio, as mentioned above, gives rise to three-dimensional crimping, whereby the fiber strength is increased, the degree of shrinkage and bulkiness of the resulting nonwoven fabric are decreased and increased, respectively, and the formation of the aforesaid aggregatable portions are further promoted. The heat-adhesive composite fibers obtainable in this manner are noticeably characterized by having many aggregatable portions formed on the sheath 2 which form a number of nodular aggregates 3 consisting of the sheath component by the heat treatment at a temperature higher than the melting point of the sheath component and lower than the lower one of the melting points of the two core components 1*a* and 1*b*. In the aggregatable portions, the sheath 2 is released from the core 1, or is not released but may latently be released from the core 1 due to their feeble interface affininity. The aggregatable portions are distinguishable from the other portions, depending upon whether or not the nodular aggregates 3 are formed by the heat treatment at the aforesaid temperature, as illustrated in FIG. 4.

When it is desired to produce the heat-adhesive composite fibers meeting the aforesaid sheath requirement and further having the aggregatable portions, the touch or feeling of the resulting nonwoven fabrics is then made by far softer, if the nonstretched yarns prepared in the following manner are used. That is, when composite spinning is carried out with three polymers, a chemical agent for reducing the interface affinity (which may hereinafter be called the affinity-reducing agent) is added to these polymers. More exactly, the affinity-reducing agent is added to both polypropylene base polymers for the two core components, or to the sole polyethylene base polymer for the sheath component, or to both the polymers for the two core components and the sole sheath component. As such affinity-reducing agents, effective use is made of polysiloxanes such as polydimethylsiloxane, phenyl-modified polysiloxane, amino-modified polysiloxane, olefin-modified polysiloxane, hydroxide-modified polysiloxane and epoxy-modified polysiloxane, and fluorine compounds such as perfluoroalkyl group-containing polymers, perfluoroalkylene group-containing polymers and modified products of these polymers. The affinity-reducing agent is added to each pertinent polymer in an amount of 0.05 to 1.0% by weight based thereon. Thus, if stretching is applied to nonstretched yarns obtained by composite spinning with the addition of the affinity-reducing agent to at least either one of the polymers for the core and sheath components, the heat-adhesive composite fibers can then be made, while further promoting the formation of the aggregatable portions.

After the composite nonstretched yarns have been stretched by the single- or multi-stage stretching, the stretched yarns are dried, as the occasion may be, and may immediately be used, or may be cut to a given length for the purpose intended.

In view of efficiency, the treatments of nonstretched yarns such as heating, cooling and stretching after spinning should preferably be carried out usually with nonstretched yarn bundles formed into a tow of several ten thousand to several million deniers. It is also preferred that such a tow is subjected to the given treatments such as heating, cooling and stretching, while passing the tow continuously therethrough or moving the tow therethrough at a low speed in an assembled state, without cutting the tow into short fibers, if possible. The treatments such as heating may be carried out in a batchwise manner, as already mentioned.

Prepared is a web consisting of the thus obtained heat-adhesive composite fibers alone or comprising at least 30 % by weight thereof and other fibers, which is then heat-treated at a temperature higher than the melting point of the sheath component and lower than the lower one of the melting points of the core components to produce the nonwoven fabric according to the present invention.

EFFECTS

The heat-adhesive composite fibers used for the nonwoven fabrics according to the present invention are of the side-by-side composite structure that the core 1 of the side-by-side type composite structure is composed of the polypropylene base polymers having different Q values and is covered with the sheath 2 of the polyethylene base polymer having a melting point lower than those of the polymers forming the core components. Accordingly, the nonwoven fabrics obtained by heat-treating webs containing such heat-adhesive composite fibers are made sufficiently bulky and extremely stabilized. The reasons are that although the heat-adhesive composite fibers forming the nonwoven fabrics are of the sheath-core structure which is generally recognized to show reduced or limited development of crimps, the crimps revealed prior to the heat treatment and the crimps developed by the heat treatment are sufficiently large and take on a moderate three-dimensional shape due to the core being of the side-by-side structure, whereby the nonwoven fabrics are made sufficiently bulky, and that since the composite fibers are of the sheath-core structure in the whole section, the sheath 2 assures sufficient heat adhesiveness and the structure of the nonwoven fabrics is extremely stabilized by the inter-fiber bonds. In addition, when many aggregatable portions formed on and at least latently releasable from the sheath due to a reduction in the interfacial affinity of the sheath 2 and the core 1 are molten and solidified by the heat treatment to give a number of nodular aggregates 3 consisting of the sheath component, improved softness is afforded to the touch or feeling of the nonwoven fabrics. The reasons are considered to be that the area of contact of the fiber surfaces is reduced to a remarkable degree, since the nodular aggregates 3 come into point contact with the surfaces of the adjacent fibers.

Accordingly, the nonwoven fabrics according to the present invention are markedly improved in terms of the bulkiness and touch or feeling which were problems in the prior art.

EXAMPLES AND COMPARATIVE EXAMPLES

In what follows, the present invention will be explained in further detail with reference to the examples and comparative examples.

I. Nonwoven fabrics comprising the composite fibers having no aggregate

EXAMPLES 1 TO 12 AND COMPARATIVE EXAMPLES 1 TO 5

(A) Preparation of heat-adhesive composite fibers

Eight polypropylenes a, b, c, d, e, f, g and h and two polyethylene base polymers i and j set forth in Table 1 were used in the combination set forth in Table 2. The composite fibers of the structure, in which the cores of the side-by-side type composite structure constructed from the core components 1*a* and 1*b* of two polypropylenes were covered with the sheaths formed of one polyethylene base polymer were prepared by the following composite-spinning, heating and stretching treatments.

The spinning nozzle used had 120 holes each of 1.0 mm in diameter. The components 1*a* and 1*b* forming the core were used in a composite ratio of 1:1, whilst the proportion of the sheath to the total amount of the core plus sheath was varied in a range of 33.3 to 66.7% by weight. Referring to the spinning temperature (the polymer temperature just prior to spinning out), the polypropylenes for both components 1*a* and 1*b* and the polyethylene base polymer were spinned at 260° C. and 220° C., respectively. In this manner, composite nonstretched yarns of 11 d/f (deniers per filament) were obtained. The composite nonstretched yarns were bundled into a tow of about 90,000 deniers, and were stretched. For stretching, three-stage rolls were used. The single-stage stretching was carried out by passing the tow through the first and second stretching rolls, whilst the double-stage stretching was done by passing the tow through the third stretching roll following the same first-stage stretching as the above-mentioned single stage stretching. Referring to the stretching temperatures, the first-stage stretching temperatures (identical with the stretching temperature in the case of the single-stage stretching) is defined as being identical with the temperature of the first stretching roll, whilst the second-stage stretching temperature is defined as being identical with the temperature of the second stretching roll. In this manner, the tow was pased through a bath containing 0.2% of a surface finishing agent at 21° C., and was successively passed through the first stretching roll of 26° C., the second stretching roll of 80° C., and the third stretching roll of 28° C. for double-stage stretching (Examples 1 to 9, Comparative Examples 1 to 5), or was passed through the second strethcing roll of 70° C. after the first stretching roll of 26° C. for single-stage stretching (Examples 10 to 12) without using the third stretching roll. Afterwards, the products of a temperature higher than room temperature were cooled down to room temperature. The strength and elongation of the thus obtained respective heat-adhesive composite fibers was measured, whilst the shape of crimps thereof was observed.

(B) Preparation of nonwoven fabrics consisting of the respective heat-adhesive composite fibers alone The respective heat-adhesive composite fibers obtained in (A) were passed twice through a carding machine to make webs, each of 100 g/m$^2$. Each web was placed in a hot-air circulation type dryer of 145° C. for 5 minutes to make a nonwoven fabric, which was in turn cooled at room temperature. The bulkiness of each nonwoven fabric was tested.

The results were set forth in Table 2.

EXAMPLES 13 TO 17 AND COMPARATIVE EXAMPLES 6–7

Preparation of nonwoven fabrics from mixed fibers of varied proportions of the heat-adhesive compsite fibers and other fibers The heat-adhesive composite fibers (2.9 d/f) obtained in Example 3 were cut to a length of 64 mm, and were mixed with rayon of 2 d×51 mm in the proportions specified in Table 3. Substantially according to the procedures of Examples 1 to 12 (B), prepared were nonwoven fabrics of about 100 g/m$^2$, the bulkiness and touch or feeling of which were tested and the strength and elongation of which were measured.

The results are set forth in Table 3. In Example 17, the results of which are also shown in Table 3, a nonwoven fabric was prepared in the same manner as mentioned above, except that 100% of the composite fibers obtained in Example 3 were used in the absence of any other fiber.

The procedures of the tests as mentioned above are as follows.

Fiber Strength and Elongation:

JIS L 1015 7.7

Crimp Shape:

After heating at 145° C. for 5 minutes, visual estimation was made of whether the fibers were three-dimensionally or two-dimensionally crimped.

Bulkiness of Nonwoven Fabric:

Each nonwoven fabric was cut into 20 cm×20 cm pieces. Such five pieces were formed into a stack on which a cardboard sheet was placed, and the thickness of one nonwoven fabric was calculated from the overall thickness of the stack to find the value in mm for bulkiness.

Strength and Elongation of Nonwoven Fabric:

Five test pieces of 20 cm×5 cm are cut of the nonwoven fabric in such a manner that their sides of 20 cm lie along the flow direction on a carding malchine. The breaking strength and elongation of the fibe test pieces are found with a tensile strength tester at a grab space of 100 mm and a draw speed of 100 mm/min., and the measurements are averaged.

TABLE 1

| | Polymer | Melting Point (°C.) | Flowability | Q valve |
|---|---|---|---|---|
| a | Polypropylene | 162 | MFR 8 | 7.4 |
| b | Polypropylene | 162 | MFR 10.2 | 6.6 |
| d | Polypropylene* | 162 | MFR 10.0 | 5.7 |
| d | Polypropylene* | 162 | MFR 12.2 | 4.5 |
| e | Polypropylene* | 162 | MFR 14.0 | 5.4 |
| f | Polypropylene* | 162 | MFR 22.0 | 4.9 |
| g | Polypropylene* | 162 | MFR 32.5 | 4.5 |
| h | Polypropylene* | 162 | MFR 34.0 | 3.6 |
| i | High-Density Polyethylene | 128 | MI 19 | — |
| j | Mixed polymer of 85 wt. % of high-density polyethylene (MP: 128° C. 3, MI:9) with 15 wt. % of ethlyene/vinyl acetate copolymer (ethylene content: 80%, MP: 94° C., and MI: 20) | 127 | MI 19.4 | — |

*Each starting polypropylene was modified by adding thereto 2,5-dimethyl-2,5-di(-tertiary-butyloxy)hexane and extruding the product out of an extruder for granuation. The starting polypropylenes c, d, e, f and h had MFRs of 6, 4, 6, 18 and 4, respectively.

TABLE 2

| | Polymer | | | Proportion of sheath (wt. %) | Q value of core components after spinning | | Flowability after spinning | | |
|---|---|---|---|---|---|---|---|---|---|
| | For core components | | For sheath component | | | | Core components (MFR) | | Sheath component (MI) |
| | 1a | 1b | | | 1a | 1b | 1a | 1b | |
| Comparative Example 1 | a | b | i | 33.3 | 7.2 | 6.0 | 12.0 | 18.1 | 22.2 |
| Comparative Example 2 | a | c | i | 33.3 | 7.2 | 5.3 | 12.2 | 16.2 | 22.0 |
| Comparative Example 3 | b | c | i | 33.3 | 6.1 | 5.3 | 17.0 | 16.4 | 22.1 |
| Comparative Example 4 | b | c | i | 33.3 | 6.1 | 5.3 | 17.0 | 16.4 | 22.1 |
| Example 1 | a | e | i | 33.3 | 7.2 | 5.0 | 12.1 | 21.2 | 22.0 |
| Example 2 | a | f | i | 33.3 | 7.2 | 4.3 | 12.1 | 29.0 | 22.1 |
| Example 3 | a | g | i | 33.3 | 7.2 | 3.9 | 12.2 | 41.1 | 22.2 |
| Example 4 | a | h | i | 33.3 | 7.2 | 3.2 | 12.0 | 46.3 | 22.0 |

TABLE 2-continued

| | | | | | | | | | |
|---|---|---|---|---|---|---|---|---|---|
| Example 5 | b | d | i | 33.3 | 6.1 | 4.2 | 17.2 | 18.4 | 22.1 |
| Example 6 | b | g | i | 33.3 | 6.1 | 3.9 | 17.0 | 41.2 | 22.1 |
| Example 7 | b | g | i | 45 | 6.1 | 3.9 | 17.0 | 41.2 | 22.1 |
| Example 8 | b | g | i | 55 | 6.1 | 3.9 | 17.0 | 41.2 | 22.1 |
| Comparative Example 5 | b | g | i | 66.7 | 6.1 | 3.9 | 17.0 | 41.2 | 22.1 |
| Example 9 | b | g | j | 33.3 | 6.1 | 3.9 | 17.0 | 41.2 | 25.0 |
| Example 10 | b | g | i | 33.3 | 6.1 | 3.9 | 17.0 | 41.2 | 22.1 |
| Example 11 | b | g | i | 45 | 6.1 | 3.9 | 17.0 | 41.2 | 22.1 |
| Example 12 | a | h | i | 33.3 | 7.2 | 3.2 | 12.0 | 46.3 | 22.0 |

| | Stretching Temperature (°C.) | | Draw ratio | | | Strength and elongation of fiber | | | Bulkiness of nonwoven fabric |
|---|---|---|---|---|---|---|---|---|---|
| | 1st Stage | 2nd Stage | 1st Stage | 2nd Stage | Overall | g/d | % | Crimp shape | (mm) |
| Comparative Example 1 | 26 | 80 | 4.4 | 0.87 | 3.83 | 3.7 | 44 | Two-dimensional | 3.6 |
| Comparative Example 2 | 26 | 80 | 4.4 | 0.87 | 3.83 | 3.7 | 43 | Two-dimensional | 3.6 |
| Comparative Example 3 | 26 | 80 | 4.4 | 0.87 | 3.83 | 3.8 | 48 | Two-dimensional | 4.3 |
| Comparative Example 4 | 26 | 80 | 4.4 | 0.87 | 3.83 | 3.7 | 45 | Two-dimensional | 4.6 |
| Example 1 | 26 | 80 | 4.4 | 0.87 | 3.83 | 3.9 | 45 | Three-dimensional | 7.2 |
| Example 2 | 26 | 80 | 4.4 | 0.87 | 3.83 | 3.9 | 52 | Three-dimensional | 7.8 |
| Example 3 | 26 | 80 | 4.4 | 0.87 | 3.83 | 3.9 | 51 | Three-dimensional | 8.0 |
| Example 4 | 26 | 80 | 4.4 | 0.87 | 3.83 | 3.7 | 58 | Three-dimensional | 7.9 |
| Example 5 | 26 | 80 | 4.4 | 0.87 | 3.83 | 3.6 | 57 | Three-dimensional | 7.2 |
| Example 6 | 26 | 80 | 4.4 | 0.87 | 3.83 | 3.7 | 50 | Three-dimensional | 6.4 |
| Example 7 | 26 | 80 | 4.4 | 0.87 | 3.83 | 3.9 | 61 | Three-dimensional | 6.9 |
| Example 8 | 26 | 80 | 4.4 | 0.87 | 3.83 | 3.6 | 60 | Three-dimensional | 6.8 |
| Comparative Example 5 | 26 | 80 | 4.4 | 0.87 | 3.83 | 3.5 | 63 | Two-dimensional | 5.1 |
| Example 9 | 26 | 80 | 4.4 | 0.87 | 3.83 | 3.7 | 46 | Three-dimensional | 7.5 |
| Example 10 | 26 | — | 4.2 | — | 4.2 | 3.6 | 48 | Three-dimensional | 7.7 |
| Example 11 | 26 | — | 4.2 | — | 4.2 | 3.6 | 48 | Three-dimensional | 7.5 |
| Example 12 | 26 | — | 4.2 | — | 4.2 | 3.5 | 62 | Three-dimensional | 7.8 |

TABLE 3

| | Mixing Ratio (weight %) | | | | | |
|---|---|---|---|---|---|---|
| | Composite Fibers | Rayon | Weight (g/m$^2$) | Bulkiness (mm) | Strength (kg/5 cm) | Elongation (%) |
| Comparative Example 6 | 10 | 90 | 99 | 3.7 | 0.25 | 185 |
| Comparative Example 7 | 20 | 80 | 97 | 3.9 | 0.36 | 136 |
| Example 13 | 30 | 70 | 102 | 5.9 | 1.02 | 92 |
| Example 14 | 40 | 60 | 98 | 6.4 | 2.70 | 94 |
| Example 15 | 60 | 40 | 100 | 6.8 | 3.28 | 83 |
| Example 16 | 80 | 20 | 104 | 7.1 | 5.47 | 76 |
| Example 17 | 100 | 0 | 98 | 7.6 | 7.96 | 66 |

From Table 2, the following are understood with respect to the relationship between the nonwoven fabrics and the structure of the heat-adhesive composite fibers forming them. More exactly, the comparison of Examples 1 to 12 with Comparative Examples 1 to 4 indicates that in the case where the two core components forming a part of the heat-adhesive composite fiber have their Q values coming under the range defined by the present invention, the development of three-dimensional crimps are so considerably noticeable that the bulkiness of the obtained nonwoven fabrics are very excellent, if other requirements satisfy the present invention. The comparison of Examples 6 to 12 with Comparative Example 5 also indicates that the nonwoven fabrics obtained by the method of the present invention are excellent in all the properties including bulkiness and the development of three-dimensional crimps; however, when use is made of the composite fibers obtained under the condition that the proportion of the sheath component departs from the presently defined range, the resulting nonwoven fabric are poor in the aforesaid properties irrespective of whether the starting polymers are identical with or different from those used in the composite fiber constituting the nonwoven fabrics obtained by the method of the present invention.

From the comparison of Comparative Examples 6 and 7 with Examples 13 to 17 in Table 3, it is also noted that when the heat-adhesive composite fibers used in the present invention are employed in an amount of at least 30% by weight in the form of fibers mixed with other fibers such as rayon, it is then possible to obtain the nonwoven fabrics excelling in bulkiness, touch or feeling and strength.

(II) Nonwoven fabrics comprising the composite fibers having aggregates

EXAMPLES 18–26 AND COMPARATIVE EXAMPLES 8–19

(A) Preparation of heat-adhesive composite fibers

Same polymers as those used in Examples 1–12(A) were used except that in Example 20 polymer i (high-density polyethylene) was used for the sheath component after being mixed with 0.10% by weight of dimethylpolysiloxane, and were processed in a similar manner to obtain the nonstretched yarns of composite fibers comprising various combinations set forth in Table 4. The composite nonstretched yarns were bundled into a tow of about 90,000 deniers, which was first heat-treated by passing it under no tension through a dry heat chamber of 105° C. for 30 seconds. (However, any heat treatment was not applied in Comparative Examples 8–10, 17 and 18). Thereafter, the tow was allowed to stand in a tow can to completely cool it down to room temperature (22° C.). Then, the tow was passed through a bath of 21° C. containing 0.2% of a surface finishing agent, and was subjected to the first-stage stretching between a pair of cold stretching rolls of 26° C. (but of 60° C. in Comparative Example 14 and of 90° C. in Comparative Examples 16 and 17 at a draw ratio of 1.6). This tow was transferred successively to the subsequent second-stage stretching process, in which it was stretched, without letting it loose, between a pair of stretching rolls heated at 90° C. (but at different temperatures in Comparative Examples 12 to 14) at the draw ratios corresponding to various per cents of various maximum draw ratios in the second-stage stretching, as specified in Table 4, and was thereafter cooled down to room temperature. The strength and elongation of each of the thus obtained heat-adhesive composite fibers were measured, whilss the shape of crimps was examined.

(B) Preparation of nonwoven fabrics consisting of the respective heat-adhesive composite fibers alone The respetive heat-adhesive composite fibers obtained in (A) were used in a manner similar to that applied in Examples 1–12(B) of the aforesaid (I) to obtain various nonwoven fabrics. Formation of the aggregates, bulkiness and touch or feeling of these nonwoven fabrics were tested.

It is to be noted that the reference nonwoven fabric for the estimation of touch or feeling was obtained from 100% of the composite fibers of Comparative Example 17 wherein the nonstretched yarn was heat-treated and stretched substantially according to the prior art.

The results were set forth in Table 4.

EXAMPLES 27 TO 31 AND COMPARATIVE EXAMPLES 20 TO 21

Preparation of nonwoven fabrics comprising mixed fibers of varied proportions of heat-adhesive composite fibers and other fibers The heat-adhesive composite fibers (2.7 d/f) obtained in Example 21 were cut to a length of 64 mm, and were mixed with rayon of 2 d×51 mm in the proportions specified in Table 5. Then, nonwoven fabrics having a weight of about 100 g/m$^2$ were obtained by a manner similar to that applied in Example 12(B), and were tested in terms of its bulkiness and touch or feeling, while measured in terms of its strength and elongation. It is to be noted that the reference nonwoven fabric for the estimation of touch or feeling was obtained by the same manner as above from 30% by weight of the composite fibers obtained in Example 17 and 70% by weight of rayon.

The results are set forth in Table 5. In Example 31, a nonwoven fabric was obtained from 100% by weight of the heat-adhesive composite fibers obtained in Example 21 in a similar manner to that applied in Example 17.

Reference is here made to the testing procedures, unexplained in the foregoing.

Formation of Aggregates

The respective heat-adhesive composite fibers prior to nonwoven fabric making were heated at 145° C. for 5 minutes, and 100 pieces of the fibers of about 3 to 12 cm in length are subjected to observation under an optical microscope. The evaluation is made according to the classification given below for the average number of the nodular aggregates per actual fiber length of 1 cm, which have a maximum diameter two times or more larger than the minimum diameter of the thinner portion adjacent thereto.

1: more than 0.30
2: 0.10 to 0.29
3: 0.01 to 0.09
4: less than 0.01

This heating condition is identical with that for nonwoven fabric making. The formation of the aggregates of such fibers was substantially identical with that of the fibers processed into a nonwoven fabric, and working of the evaluation is very difficult after nonwoven fabric making.

Touch or Feeling of Nonwoven Fabric

The touch or feeling of the nonwoven fabrics was examined by a five-man panel test, while comparing with that of the reference nonwoven fabric. Estimation was made by majority in terms of the following numerals.

1: Softness was very good
2: Softness was considerably good
3: Softness was substantially identical
4: Softness was poor The aforesaid reference nonwoven fabric for the estimation of touch or feeling was obtained from the composite fibers of Comparative Example 17 wherein the nonstretched yarn was stretched substantially according to the prior art.

The results are shown in Table 4.

TABLE 4

| Polymer | Proportion | Q value of Core compo- | Flowability After Spinning Core | Stretching |
|---|---|---|---|---|

TABLE 4-continued

| | for Core Components | | Polymer for Sheath Component | of Sheath | After Spinning | | Components (MFR) | | Sheath Component | Temperature | |
|---|---|---|---|---|---|---|---|---|---|---|---|
| | 1a | 1b | | (wt. %) | 1a | 1b | 1a | 1b | (MI) | 1st Stage | 2nd Stage |
| Comparative Example 8* | a | b | i | 33.3 | 7.2 | 6.0 | 12.0 | 18.1 | 22.2 | 26 | 90 |
| Comparative Example 9* | a | c | i | 33.3 | 7.2 | 5.3 | 12.2 | 16.2 | 22.0 | 26 | 90 |
| Comparative Example 10* | b | c | i | 33.3 | 6.1 | 5.3 | 17.0 | 16.4 | 22.1 | 26 | 90 |
| Comparative Example 11 | b | c | i | 33.3 | 6.1 | 5.3 | 17.0 | 16.4 | 22.1 | 26 | 90 |
| Example 18 | a | e | i | 33.3 | 7.2 | 5.0 | 12.1 | 21.2 | 22.0 | 26 | 90 |
| Example 19 | a | e | i** | 33.3 | 7.2 | 5.0 | 12.0 | 21.0 | 22.3 | 26 | 90 |
| Example 20 | a | f | i | 33.3 | 7.2 | 4.3 | 12.1 | 29.0 | 22.1 | 26 | 90 |
| Example 21 | a | g | i | 33.3 | 7.2 | 3.9 | 12.2 | 41.1 | 22.2 | 26 | 90 |
| Example 22 | a | h | i | 33.3 | 7.2 | 3.2 | 12.0 | 46.3 | 22.0 | 26 | 90 |
| Example 23 | b | d | i | 33.3 | 6.1 | 4.2 | 17.2 | 18.4 | 22.1 | 26 | 90 |
| Comparative Example 12 | b | g | i | 33.3 | 6.1 | 3.9 | 17.0 | 41.2 | 22.1 | 26 | 26 |
| Comparative Example 13 | b | g | i | 33.3 | 6.1 | 3.9 | 17.0 | 41.2 | 22.1 | 26 | 70 |
| Comparative Example 14 | b | g | i | 33.3 | 6.1 | 3.9 | 17.3 | 41.0 | 22.1 | 60 | 70 |
| Comparative Example 15 | b | g | i | 33.3 | 6.1 | 3.9 | 17.0 | 41.2 | 22.1 | 26 | 90 |
| Comparative Example 16 | b | g | i | 33.3 | 6.1 | 3.9 | 17.0 | 41.2 | 22.1 | 90 | 90 |
| Comparative Example 17* | b | g | i | 33.3 | 6.1 | 3.9 | 17.0 | 41.2 | 22.1 | 90 | 90 |
| Example 24* | b | g | i | 33.3 | 6.1 | 3.9 | 17.0 | 41.2 | 22.1 | 26 | 90 |
| Example 25 | b | g | i | 45 | 6.1 | 3.9 | 17.0 | 41.2 | 22.1 | 26 | 90 |
| Example 26 | b | g | i | 55 | 6.1 | 3.9 | 17.0 | 41.2 | 22.1 | 26 | 90 |
| Comparative Example 18 | b | g | i | 66.7 | 6.1 | 3.9 | 17.0 | 41.2 | 22.1 | 26 | 90 |
| Example 27 | b | g | j | 33.3 | 6.1 | 3.9 | 17.0 | 41.2 | 25.0 | 26 | 90 |

| | Draw Ratio | | Maximum Draw Ratio in Second-Stage Stretching(B) | A/B × 100(%) | Strength and Elongation of Yarn | | Crimp Shape | Degree of Aggregatability | Bulkiness of Nonwoven Fabric (mm) | Touch or Feeling of Nonwoven Fabric |
|---|---|---|---|---|---|---|---|---|---|---|
| | 1st Stage | 2nd Stage(A) | | | g/d | % | | | | |
| Comparative Example 8* | 1.6 | 2.8 | 3.0 | 93 | 3.9 | 42 | Two-Dimensional | 4 | 3.5 | 4 |
| Comparative Example 9* | 1.6 | 2.7 | 2.9 | 93 | 3.9 | 40 | Two-Dimensional | 4 | 3.5 | 4 |
| Comparative Example 10* | 1.6 | 2.8 | 3.0 | 93 | 4.0 | 46 | Two-Dimensional | 4 | 4.5 | 4 |
| Comparative Example 11 | 1.6 | 2.6 | 2.8 | 93 | 3.9 | 42 | Two-Dimensional | 3 | 4.6 | 3 |
| Example 18 | 1.6 | 2.9 | 3.2 | 91 | 4.2 | 40 | Three-Dimensional | 2 | 7.7 | 2 |
| Example 19 | 1.6 | 2.8 | 3.0 | 93 | 4.0 | 43 | Three-Dimensional | 1 | 7.5 | 1 |
| Example 20 | 1.6 | 2.9 | 3.1 | 24 | 4.0 | 48 | Three-Dimensional | 1 | 7.7 | 1 |
| Example 21 | 1.6 | 2.9 | 3.2 | 91 | 4.0 | 50 | Three-Dimensional | 2 | 7.8 | 1 |
| Example 22 | 1.6 | 3.0 | 3.3 | 91 | 3.8 | 58 | Three-Dimensional | 1 | 7.5 | 1 |
| Example 23 | 1.6 | 2.9 | 3.1 | 94 | 3.8 | 54 | Three-Dimensional | 1 | 7.0 | 1 |
| Comparative Example 12 | 1.6 | 1.8 | 2.0 | 90 | 2.4 | 90 | Three-Dimensional | 3 | 4.0 | 3 |
| Comparative Example 13 | 1.6 | 2.2 | 2.4 | 92 | 2.6 | 78 | Three-Dimensional | 3 | 3.5 | 3 |
| Comparative Example 14 | 1.6 | 2.6 | 2.9 | 91 | 3.6 | 67 | Two-Dimensional | 3 | 3.3 | 3 |
| Comparative Example 15 | 1.6 | 2.6 | 3.2 | 81 | 2.8 | 74 | Three-Dimensional | 3 | 3.6 | 3 |
| Comparative Example 16 | 1.6 | 2.5 | 3.5 | 71 | 2.6 | 81 | Two-Dimensional | 4 | 3.5 | 3 4 |
| Comparative Example 17* | 1.6 | 3.5 | 3.8 | 92 | 3.9 | 38 | Two-Dimensional | 4 | 3.1 | 3 |
| Example 24* | 1.6 | 3.0 | 3.3 | 91 | 3.8 | 48 | Three-Dimensional | 4 | 6.1 | |
| Example 25 | 1.6 | 3.0 | 3.3 | 91 | 3.9 | 58 | Three-Dimensional | 2 | 7.0 | 2 |
| Example 26 | 1.6 | 2.9 | 3.2 | 91 | 3.8 | 56 | Three-Dimensional | 2 | 6.2 | 2 |
| Comparative Example 18 | 1.6 | 2.9 | 3.2 | 91 | 3.7 | 60 | Two-Dimensional | 3 | 5.0 | 4 |

TABLE 4-continued

| | | | | | | | | | | |
|---|---|---|---|---|---|---|---|---|---|---|
| Example 27 | 1.6 | 2.9 | 3.1 | 94 | 3.9 | 42 | Three-Dimensional | 1 | 7.0 | 1 |

*The nonstretched yarns were not heated in Comparative Example 8, 9, 10, 17 and Example 24.
**0.10% by weight of dimethylpolysiloxane was mixed.

TABLE 5

| | Mixing Ratio (weight %) | | | | | | |
|---|---|---|---|---|---|---|---|
| | Composite Fibers | Rayon | Weight ($g/m^2$) | Touch or Feeling | Bulkiness (mm) | Strength (kg/5 cm) | Elongation (%) |
| Comparative Example 19 | 10 | 90 | 102 | 4 | 3.8 | 0.21 | 180 |
| Comparative Example 20 | 20 | 80 | 100 | 3 | 3.9 | 0.32 | 120 |
| Example 28 | 30 | 70 | 98 | 2 | 5.8 | 1.01 | 90 |
| Example 29 | 40 | 60 | 100 | 2 | 6.3 | 2.58 | 90 |
| Example 30 | 60 | 40 | 98 | 2 | 6.8 | 3.04 | 84 |
| Example 31 | 80 | 20 | 101 | 1 | 7.1 | 5.44 | 75 |
| Example 32 | 100 | 0 | 100 | 1 | 7.7 | 7.76 | 68 |
| Standard Reference Nonwoven Fabric | 30 | 70 | 98 | — | 3.4 | 1.08 | 94 |

From Table 4, the following are understood with regard to the relationship between the nonwoven fabrics and the structure of the hea-adhesive composite fibers forming them. More exactly, the comparison of Examples 18 to 27 with Comparative Examples 8 to 11 indicates that when the two core components have their Q values within the range defined by the present invention, the development of three-dimensional crimps are so considerably noticeable that the obtained nonwoven fabrics excel in bulkiness, as in Examples 1 to 12, if other requirements satisfy the present invention. From the comparison of Examples 24 to 26 with Comparative Examples 12 to 18, it is further noted that the nonwoven fabrics obtained by the method of the present invention are excellent in all the properties including bulkiness and the development of three-dimensional crimps; however, the nonwoven fabrics obtained using the composite fibers prepared under conditions in which the proportion of the sheath, the stretching temperature, the draw ratio, etc. departed from the presently defined range are poor in the aforesaid properties, even though the same starting polymer is used. From the comparison of Examples 25 and 26 with Example 24 in particular, it is still further noted that the nonwoven fabrics obtained by the method of the present invention using the composite fibers prepared by applying the heat treatment prior to stretching of the composite nonstretched yarns are more excellent in the formation of the aggregates and hence touch or feeling than those obtained using the composite fibers obtained without any heat treatment. Accordingly, it is found that the heat treatment of the compoiste nonstretched yarn takes great part in the formation of the aggregates. From Examples 18 and 19, it is also noted that a much larger number of the aggregates are formed in the nonwoven fabric in which the affinity-reducing agent such as polysiloxane is added to the raw polymer than the nonwoven fabric in which such a agent is not added to the raw polymer.

From the comparison of Comparative Examples 19 to 20 with Examples 28 to 32 in Table 5, it is still further noted that when at least 30% by weight of the heat-adhesive composite fibers used in the present invention are used in the form of fibers mixed with other fibers such as rayon, it is then possible to obtain the nonwoven fabrics excelling in bulkiness, touch or feeling and strength.

What is claimed is:

1. A nonwoven fabric comprising at least 30% by weight of heat-adhesive composite fibers comprising a core portion and a sheath portion, said core portion being of the side-by-side type composite structure comprising two core components of different polypropylene base polymers in a composite ratio of 1:2 to 2:1, one of said core components having a Q value, expressed in terms of the weight-average molecular weight/the number-average molecular weight, equal to or higher than 6 and the other having a Q value equal to or lower than 5, said sheath portion meeting at least the requirement that it should comprise a sheath component of a polyethylene base polymer having a melting point lower by at least 20 ° C. than the lower one of the melting points of said two core components, and said sheath portion covering completely said core portion in a proportion of 25 to 55% by weight based on the total weight of it and said core portion, and which is stabilized by the inter-fiber bonds of the sheath portion of said heat-adhesive composite fibers.

2. A nonwoven fabric as defined in claim 1, in which said sheath portion of said heat-adhesive composite fibers satisfies said requirement alone.

3. A nonwoven fabric as defined in claim 1, in which said sheath portion of said heat-adhesive composite fibers satisfies said requirement, and include thereon a number of nodular aggregates formed of said sheath component.

4. A nonwoven fabric as defined in any of claims 1 to 3, in which at least one polypropylene base polymer of said two core components of said heat-adhesive composite fibers is polypropylene.

5. A nonwoven fabric as defined in any of claims 1 to 3, in which at least one polypropylene base polymer of said two core components of said heat-adhesive composite fibers is a copolymer of propylene with a small amount of an alph-olefin other than propylene.

6. A nonwoven fabric as defined in any one of claims 1 to 3, in which the polyethylene base polymer of said sheath component of said heat-adhesive fibers is polyethylene.

7. A nonwoven fabric as defined in any one of claims 1 to 3, in which the polyethylne base polymer of said sheath component of said heat-adhesive composite fibers is a copolymer of ethylene with vinyl acetate having an ethylene content of 98 to 60% by weight.

8. A method for producing nonwoven fabrics which comprises the steps of:

separately subjecting to composite-spinning two polypropylene base polymers for two core components and a polyethylene base polymer for a sheath component, which has a melting point lower by at least 20 ° C. than the lower one of the melting points of said two polypropylene base polymers, thereby obtaining composite nonstretched yarns of the structure that a core portion of the side-by-side type composite structure consisting of two core components in a composite ratio of 1:2 to 2:1, one of said core components having a Q value, expressed in terms of the weight-average molecular weight/the number-average molecular weight, equal to or higher than 6 and the other having a Q value equal to or lower than 5, is completely covered with a sheath portion comprising said sheath component in a weight proportion of 25 to 55% by weight based on the total weight of it and said core portion, stretching said composite nonstretched yarn by a one- or more-stage stretching process to prepare heat-adhesive composite fibers, preparing a web containing at least 30% by weight of said heat-adhesive composite fibers, and heat-treating said web at a temperature higher than the melting point of said sheath component and lower than the lower one of the melting points of said core components.

9. A method for producing nonwoven fabrics as defined in claim 8, in which, at the stretching step, said composite nonstretched yarns are stretched at a temperature of normal temperature 130° C. in an overall draw ratio of 1.3 to 9.

10. A method for producing nonwoven fabrics as defined in claim 8, in which, prior to stretching of said composite nonstretched yarns, said composite yarns are heated under no tension at a temperature of 80° C. to below the melting point of said sheath component for 10 seconds or longer and cooled down to normal temperature, and is then subjected to the first-stage stretching at normal temperature and a draw ratio of 1.3 to 2, and without letting the yarns loose they are subsequently subjected to the second-stage stretching at a temperature of 80° C. to below the melting point of said sheath component and a draw ratio of at least 90% of the maximum draw ratio of the second-stage stretching, then make the heat-adhesive composite fibers have many aggregatable portions on their sheath portions.

11. A method for producing nonwoven fabrics as defined in claim 10, in which, at the composite spinning step, 0.05 to 1.0% by weight of at least one member selected from the group consisting of polysilosxanes and fluorine compounds is added to at least one of said polypropylene base polymers for said core components and the polyethylene base polymer for said sheath component, which are then subjected to the composite-spinning to obtain composite nonstretched yarns.

* * * * *